United States Patent [19]

Foller et al.

[11] 4,375,395

[45] Mar. 1, 1983

[54] PROCESS FOR PRODUCING OZONE

[76] Inventors: Peter C. Foller, 220 J Red Oak W., Sunnyvale, Calif. 94086; Mark L. Goodwin, 17165 Buena Vista, Los Gatos, Calif. 95030; Charles W. Tobias, 524 Moraga Way, Orinda, Calif. 94563

[21] Appl. No.: 263,155

[22] Filed: May 21, 1981

[51] Int. Cl.[3] ..... C25B 1/00; C25B 1/04

[52] U.S. Cl. ..... 204/129; 204/294

[58] Field of Search ..... 204/129, 294, 290 R, 204/128

[56] References Cited

U.S. PATENT DOCUMENTS 3,256,164 6/1966 Donohue et al. ..... 204/129

4,235,695 11/1980 De Nova et al. ..... 204/294

OTHER PUBLICATIONS

Analytical Chemistry, UDC. 37, No. 2, Feb. 1965, pp. 200 et. seq.—Zittal et al.—"A Glassy-Carbon Electrode for Voltammetry."

Encyclopedia of Electrochemistry of the Elements—A. J. Bard—Chap. 4—Applied Electrochemistry, pp. 146-151.

Chemical Abstracts, vol. 83, 1975, p. 520, Abstract No. 104309g—Samchenko et al.—"Formation of ozone on lead oxide during electrolysis of perchloric acid."

Chemical Abstracts, vol. 82, 1975, p. 602, Abstract No. 66161c—Ordzhonikidze S. Polytechnic Institute, Movocherkassk (Russian Patent 380106).

Chemical Abstracts, vol. 92, 1980, p. 478, Abstract No. 101404q—Heinz et al.—"Electrochemical Synthesis. XVII. Ozone Synthesis by Electrolysis of Water."

*Primary Examiner*—Howard S. Williams

[57] ABSTRACT

In electrolytic cells for producing ozone, the ozone current efficiencies can be enhanced by providing electrodes, and especially anodes, fabricated from glassy carbon. Cells including such glassy carbon electrodes are capable of producing ozone at very high current efficiencies utilizing aqueous electrolytes of highly electronegative fluoro-anions.

2 Claims, No Drawings

PROCESS FOR PRODUCING OZONE

DESCRIPTION

1. Technical Field

This invention relates generally to the electrolytic production of ozone and more particularly to improved electrodes for use in an ozone production method wherein aqueous solutions of highly electronegative anions are electrolyzed between electrodes in which at least the anode is fabricated from the glassy form of carbon.

2. Background of the Invention

In a co-pending patent application Ser. No. 154,584, entitled "Improved Electrolytic Process for the Production of Ozone" filed May 29, 1981, now U.S. Pat. No. 4,316,782 issued Feb. 23, 1982, two of the present inventors, Foller and Tobias, disclosed processes for the production of ozone by electrolytic means. These processes were revealed as being capable of producing ozone in current efficiencies of 50% or better from aqueous solutions of highly electronegative anions. Use of the fluoro-anions in acidic solutions is especially preferred for these aqueous electrolytes. The term "fluoro-anions" is used herein to describe that family of anionic (negatively charged) species in which multiple fluorine ligands complex a central atom.

Such electrolytic solutions can be highly corrosive to the cell materials if they are not selected properly, and especially hard on the electrodes where electrochemical discharge takes place. In addition, the liberated $O_3$, being a powerful oxidizing agent, also strongly acts upon electrode materials which are susceptible to oxidizing action. The electrical properties of the electrode material are also important to the successful and effective operation of the ozone generating electrolytic cell. The electrodes must exhibit sufficient electrical conductivity to enable the utilization of current densities required by the ozone generating process without an unacceptable anode potential and must also be adaptable to whatever cooling procedures are required to maintain cell temperatures during operation.

The referenced pending application referred to two electrode, especially anode, materials which are preferred for use in the electrolytic process. One material is platinum and the second material is lead dioxide, preferably in the beta crystalline form. While these materials are suitable for the cell anode, it will be recognized that alternate electrode materials would be of interest. The high cost of platinum electrodes in an apparatus in wide-spread industrial use is self-evident. Lead dioxide, while exhibiting superior ozone current efficiencies, does suffer from corrosion susceptibility unless carefully prepared and fabricated and used under well-defined circumstances.

BRIEF DESCRIPTION OF THE INVENTION

The present invention presents an alternate material for use as electrodes, especially anodes, in ozone generating electrolytic processes employing highly electronegative fluoro-anions in the aqueous electrolyte. This material is a special form of carbon, known as glassy, or vitreous carbon. This glassy carbon is one of a number of forms that carbon may assume. These divergent forms such as ordinary graphite, pyrolytically grown graphite, turbostatic and activated carbon blacks, and diamond, exhibit physical and chemical properties varying over a vast range.

Glassy carbon is a relatively recently available form of carbon that exhibits a high degree of resistance to oxidation and possesses high stability to chemical attack. Due to the complex and often proprietary method of production, glassy carbon is somewhat more expensive when compared with other of the more common forms of carbon.

In any event, it has now been determined that anodes made of glassy carbon are eminently suitable for use in the preparation of ozone in an electrolytic cell utilizing aqueous solutions of the highly electronegative fluoro-anions. It is therefore an object of the invention to provide electrodes for ozone producing electrolytic cells.

It is another object of the invention to provide glassy carbon electrodes for ozone producing electrolytic cells.

It is another object of the invention to provide glassy carbon electrodes for ozone producing electrolytic cells which utilize fluoro-anions in the electrolyte.

Other objects and advantages of the invention will become apparent from a review of the following specification and the claims appended hereto.

DETAILED DESCRIPTION OF THE INVENTION

When aqueous solutions of the highly electronegative fluoro-anions are electrolyzed in aqueous solutions by impressing a suitable current and voltage across electrodes contacting the electrolyte, a mixture of $O_2$ and $O_3$ gases is liberated at the anode, while $H_2$ gas is liberated at the cathode. Alternately, oxygen depolarized cathodes may be employed, water then being reformed at the cathode. In this form of electrolytic cell, the sole gaseous product is the $O_2$–$O_3$ mixture liberated at the anode.

The electrolytic solution of highly electronegative fluoro-anions is typically a strongly acidic fluid, and this acidity, along with the electrochemical discharge at the electrode surfaces, produces severe corrosive conditions. Thus the anode material, from a practical standpoint, must be able to withstand the corrosive environment; but, at the same time, suitably conduct the electric current necessary to effect dissociation of the electrolyte and evolve the required $O_2$–$O_3$ mixture. Not only must the above conditions be met, but, in addition, the anode material must be capable of sustaining the high oxygen overvoltages necessary to increase the yield of ozone relative to the yield of oxygen.

The severe environment and unique electrical requirements of the ozone electrolytic cell utilizing fluoro-anions on the cell anode material can be met by that form of carbon known as glassy, or vitreous, carbon. Anodes prepared from glassy carbon compare favorably with the anode materials, i.e., platinum and $\beta$-lead dioxide, previously disclosed in co-pending application Ser. No. 154,584, (now U.S. Pat. No. 4,316,782) referenced above.

Glassy carbon is a particular form of carbon prepared by the controlled pyrolysis of successive layers of organic solutions of long-chain polymeric precursors in an inert atmosphere. The random structure of the polymer is nearly preserved, with only sub-microscopic graphitic regions occuring. Extraordinary chemical and physical properties result from this process. A high degree of resistance to oxidation, even at elevated temperature, is achieved. In many circumstances where ordinary forms of carbon (such as graphite, the most generally inert) degrade, glassy carbon remains unaffected. The intergraphitic plane intrusion mechanism of attack is inhibited due to the absence of long-range order in glassy carbon.

The physical, chemical and electrochemical properties of glassy carbon vary with the method of preparation. Several starting polymeric resins are used, and pyrolysis temperatures ranging from 600° to 3000° C. are employed. The heat treatment time is also of influence on the ultimate properties. With these three variables it is possible to obtain varying proportions of $sp^2$ and $sp^3$ coordination of individual atoms. This then determines density, chemical inertness, and electrical and electrochemical properties traceable to variations in band gap. In general, resistivities of 30 to $80\times10^{-4}$ ohm-cm are encountered. With all preparation methods the carbons are extremely hard (6 to 7 Mohs scale), non-porous, and gas impermeable.

Glassy carbon is commercially available from such sources as the Tokai Mfg. of Japan, and LeCarbone-Lorraine of France. However, due to limited application, and time consuming preparation, glassy carbon remains expensive.

Since glassy carbon is extremely hard and brittle, special techniques must be employed to shape and prepare it for use as an anode in the electrolytic cell. Fortunately the material can be ordered from the manufacturers in a great variety of sizes and shapes; and, in fact, can be pyrolyzed from the forming resin to most any size or shape specified by the consumer.

Electrical connection to the electrode can be by a number of means. Mercury contacts and electrically conductive epoxy pastes (silver filled) are several suitable types of connection of the electrode to the source of power.

The glassy carbon is isotropic and for this reason, unlike pyrolytically grown graphite, it does not require any definite orientation in the electrolytic cell. In addition, at least with $BF_4^-$ and $PF_6^-$ anion solutions, the glassy carbon anodes appear to be more corrosion resistant with increasing ionic and acidic concentrations.

Three different glassy carbon samples were used to evaluate anodes for the evolution of ozone, these were: an analytical electrode, presumed to have been produced by Tokai Electrode Mfg. of Japan and distributed by Princeton Applied Research (PAR), and two plates supplied by the Gallard Schesinger Co. and believed to have been made by LeCarbone-Lorraine, France.

The starting materials of the PAR electrode was either a furfuryl alcohol or phenol formaldehyde resin, the Gallard Schlesinger starting materials being proprietary. The heat treatment temperature (HTT) of the PAR material was unknown, whereas the two Gallard Schlesinger samples (GS V-10, GS V-25) differed only in their heat treatment. The GS V-10 sample was heat treated to 1000° C., and the GS V-25 material was heat treated to 2500° C. These differences gave rise to variations in yield of ozone when the materials are employed as anodes.

For experimental testing the above electrode materials were machined into 1 to 2 $cm^2$ samples of approximately 1 mm thickness and pressfit into teflon holders. Silver epoxy connections were then made to the rear surface of the carbon samples within a hollow cavity of the teflon holders.

As an anode for the evolution of ozone, glassy carbon meets the required criteria of stability to high concentrations of strong acid and to anodic polarization at high current density. The overpotential for oxygen evolution is comparable to that of platinum and lead dioxide. A high oxygen overvoltage is necessary to inhibit the competitive reaction of oxygen evolution and thus enhance ozone yields. Yields on the order of 25 to 30% current efficiency have been regularly reproduced in 7.3 M $HBF_4$ (tetrafluoroboric acid) electrolyte at 0° C.; as compared with yields of 18% with $PbO_2$ and 5% with Pt under identical conditions. Pressed carbon black and graphite rapidly degrade under these circumstances, and evolve only traces of ozone.

The GS V-10 glassy carbon anode was tested at increasing current densities in various concentrations of tetrafluoroboric acid at 0° C. At a current density of about 0.24 $A/cm^2$, the ozone current efficiency (ratio of $O_3$ gas evolved relative to $O_2$ gas evolved) was about $1\frac{1}{2}$% for 2 M $HBF_4$, about 10% for 5 M $HBF_4$, and about 21% for 7.3 M $HBF_4$. At a current density of about 0.56 $A/cm^2$, the ozone current efficiency was about 2% for 2 M $HBF_4$, about 15% for 5 M $HBF_4$, and about 26.5% for 7.3 M $HBF_4$. At a current density of about 0.86 $A/cm^2$, the ozone current efficiency of 2 M $HBF_4$ remained at the 2% level, while 5 M $HBF_4$ had increased to about 17%, and 7.3 M $HBF_4$ had increased to about 28.5%. The current efficiencies remained at the same levels when current densities were increased further.

The electrode was visibly attacked at the 2 M concentration, less at 5 M, and apparently not at all at 7.3 M, the highest concentration level of $HBF_4$ available commercially.

The GS V-10 and GS V-25 anodes were compared to test the effect attributable to the method of preparation of glassy carbon. When run in 7.5 M $HBF_4$ at 0° C. at various current densities, the GS V-10 anode yielded consistently higher ozone current efficiencies. At a current density of about 0.2 $A/cm^2$, the GS V-10 anode yielded about a 14% current efficiency, and the GS V-25 anode-yielded about an 11% current efficiency. At 0.4 $A/cm^2$, the GS V-10 anode yielded about a 21% current efficiency, while the GS V-25 anode yielded about a 16% current efficiency. At a current density of 0.6 $A/cm^2$, the GS V-10 anode yielded about a 24% current efficiency, while the GS V-25 anode yielded about a 19% current efficiency. At 1.0 $A/cm^2$, the GS V-10 anode yielded about 24.5% ozone current efficiency, and the GS V-25 anode yielded about 22% ozone efficiency.

Both samples were inert to electrochemical or corrosive attack during the tests.

The glassy carbon anodes were also independent of time in the production of ozone. That is, the ozone current efficiencies remained constant over a run of about 2 hours at current densities of 0.4 $A/cm^2$ to 0.8 $A/cm^2$. These constant ozone current efficiencies are in contrast to the behavior of Pt and $PbO_2$ anodes which exhibit rise times of 30 and 90 minutes, respectively.

Further tests with the PAR glassy carbon anode indicated that ozone current efficiencies, as in the case of Pt and $PbO_2$ anodes, decrease as the electrolyte temperature increases. Nonetheless, ozone current efficiencies of about 25% were exhibited when the cell was run with water from the city mains (about 13° C.) as the coolant.

When glassy carbon anodes were run in contact with electrolytes other than $HBF_4$ and $HPF_6$, ozone current efficiences were poor. Yields in $H_2SiF_6$ and $H_2SO_4$ electrolytes gave only 1 to 2% ozone current efficiencies. In addition, anode corrosion was excessive. $HPF_6$ yields were comparable to those in $HBF_4$.

From the above tests it is apparent that glassy carbon is an anode material comparable to both Pt and $PbO_2$ for use in electrolytic cells for the generation of ozone from aqueous electrolytes of highly electronegative fluoro-anions.

We claim:

1. A method for producing ozone at high current efficiencies from an electrolytic cell comprising passing an electric current at high oxygen overvoltages through a bare glassy carbon anode and a cathode into an electrolyte comprising a strongly acidic aqueous solution of highly electronegative $BF_4^-$ fluoro-anions.

2. A method for producing ozone at high current efficiency from an electrolytic cell comprising passing an electric current at high oxygen overvoltages through a bare glassy carbon anode and a cathode into an electrolyte comprising a strongly acidic aqueous solution of highly electronegative $PF_6^-$ fluoro-anions.

* * * * *